US006823793B2

(12) United States Patent
Dewitte

(10) Patent No.: US 6,823,793 B2
(45) Date of Patent: Nov. 30, 2004

(54) METHOD AND APPARATUS FOR MOUNTING FLEXOGRAPHIC PLATE SEGMENTS

(75) Inventor: Hans Dewitte, Brugge (BE)

(73) Assignee: Esko Graphics, NV, Zwijnaarde (BE)

( * ) Notice: Subject to any disclaimer, the term of this patent is extended or adjusted under 35 U.S.C. 154(b) by 102 days.

(21) Appl. No.: 10/336,944

(22) Filed: Jan. 6, 2003

(65) Prior Publication Data

US 2004/0129157 A1 Jul. 8, 2004

(51) Int. Cl.[7] ..... B41F 1/34

(52) U.S. Cl. ..... 101/485; 101/486; 101/382.1; 101/389.1

(58) Field of Search ..... 101/483–486, 101/389.1, 477, 382.1, 378, 463.1, 401.1

(56) References Cited

U.S. PATENT DOCUMENTS

| | | | | |
|---|---|---|---|---|
| 4,543,615 A | | 9/1985 | Van Campenhout et al. | 358/285 |
| 4,611,539 A | * | 9/1986 | Ireton | 101/401.1 |
| 5,132,911 A | | 7/1992 | Leader, Jr. et al. | 364/469 |
| 5,377,590 A | * | 1/1995 | Bolza-Schunemann et al. | 101/389.1 |
| 5,715,750 A | | 2/1998 | Goovaard | 101/382.1 |
| 5,828,501 A | | 10/1998 | Menard et al. | 359/819 |
| 5,846,691 A | | 12/1998 | Cusdin et al. | 430/300 |
| 5,850,789 A | | 12/1998 | Rudolf et al. | 101/486 |
| 5,912,458 A | | 6/1999 | Squires et al. | 250/234 |
| 5,974,974 A | | 11/1999 | Agnew et al. | 101/401.1 |
| 6,058,839 A | | 5/2000 | Frazzitta | 101/401.1 |
| 6,079,329 A | | 6/2000 | Goovaard et al. | 101/376 |
| 6,085,653 A | | 7/2000 | Goovaard et al. | 101/376 |
| 6,112,664 A | * | 9/2000 | Naniwa et al. | 101/463.1 |
| 6,170,396 B1 | * | 1/2001 | Naniwa et al. | 101/382.1 |
| 6,312,871 B1 | | 11/2001 | Cusdin et al. | 430/273.1 |
| 2002/0025492 A1 | | 2/2002 | Murphey et al. | 430/271.1 |

FOREIGN PATENT DOCUMENTS

| | | | |
|---|---|---|---|
| EP | 0 922 578 A1 | 6/1999 | B41F/27/00 |
| WO | WO0145951 | 6/2001 | B41F/27/12 |

OTHER PUBLICATIONS

Web Brochure, Kongsburg FC1309 and FC1318 Samplemakers, Barco Graphics, Gent, Belgium. Downloaded from http://unix.barco.com/graphics/packaging/products/ (Barco Graphics is now Esko–Graphics, NV).

Web Brochure, DuPont Cyrel Macroflex, downloaded from http://www.cyrel.dupont.com/.

Web Brochure, The Kongsberg XL–Series, Barco Graphics, Gent, Belgium. Downloaded from http://www.barco.com/graphics (Barco Graphics is now Esko–Graphics, NV).

* cited by examiner

*Primary Examiner*—Minh Chau
(74) *Attorney, Agent, or Firm*—Dov Rosenfeld; Inventek

(57) ABSTRACT

A method and apparatus for mounting printing plate segments on a printing plate carrier comprising accepting positioning data indicative of a set of first positions and loading the imaged segments onto a working surface of the loading table at approximately the corresponding first positions. The method further includes, for each segment, detecting the position of the segment on the table, and using a mechanical pick-up system to pick up the segment and to carry the segment to a final position on the carrier. The carrying is via a path determined using the detected position on the table and the final position. The table's working surface has a set of vacuum holes coupled to a vacuum system. The mechanical pick up system includes a plurality of suction caps coupled to the vacuum system to pick up the plate. One version includes a mechanism for cutting the segments from the sheet.

66 Claims, 7 Drawing Sheets

METHOD AND APPARATUS FOR MOUNTING FLEXOGRAPHIC PLATE SEGMENTS

BACKGROUND

This invention relates to the field of printing, and in particular to a method and apparatus for mounting flexographic or letterpress plate segments onto a printing plate carrier.

Flexography and letterpress use printing cylinders on which printing plates are mounted using different mounting methods. When printing in color, one cylinder is used for each color, i.e., for each color separation.

Conventional printing uses a single printing plate on the cylinder covering the whole area to be printed. An alternate is using a plurality of segments of plate material mounted on the cylinder. Such a method uses less printing plate material than using a single plate covering the whole area to be printed, and is suitable for flexography and letterpress because flexographic and letterpress plate material is relatively expensive. An economical method for creating plate segments, each containing register marks is described in U.S. patent application Ser. No. 09/946,145 to Klein, et al., titled "METHOD, APPARATUS, AND COMPUTER PROGRAM FOR REDUCING PLATE MATERIAL WASTE IN FLEXOGRAPHY."

A known manual method for mounting the plate segments onto a carrier to produce a cylinder with multiple plate segments includes first producing flat printing plate sheets, cutting the plate segments, and manually mounting the segments onto a printing plate carrier such as a drum, sleeve, or a mylar sheet. Several tools exist to facilitate this operation, e.g., so that the operation is more repeatable. Success is highly dependent on the skill of the operator.

The manual method includes applying glue to the back of the printing plate segments or making the printing plate carrier adhesive, e.g., by applying glue or by using double sided adhesive tape. The manual method further includes the operator manually aligning register marks on the printing plate segments with marks that have been provided by a mounting apparatus. The operator can use a prior-art mounting apparatus for this. The apparatus helps registering by using a half-transparent mirror or a video screen to display a register mark on top of the image of the plate segments. In all such procedures, an operator manually decides where to mount the plate segment. As a result, the quality of the resulting printing cylinders may vary depending on the skill of the operator. Furthermore, the mounting may take a relatively long time, especially when high precision is required. Furthermore, large plate segments are more difficult to mount than smaller plate segments, mainly because it is difficult for human operators to handle large plate segments.

An apparatus that help a human operator to mount printing plate segments onto a printing cylinder is called a manual mounting machines herein, and the mounting method is called a manual mounting method.

Another prior art method for producing cylinders that include printing plate segments produces the printing cylinders directly. Blank, unimaged plate segments are applied on a cylindrical plate carrier, typically a sleeve, and imaged in a computer-to-plate drum imaging device such as the Esko-Graphics Cyrel Digital Imager (Esko-Graphics NV, Gent, Belgium, the assignee of the present invention). The imaging device is used to directly expose the sleeve carrying the flexographic plate segments. After exposure, the cylindrical plate carrier with the exposed plate segments attached is moved away from the imaging device and processed in round washing equipment. Because the printing plate segments are not removed from the sleeve or printing cylinder for the processing, the image register is maintained throughout the process until printing. The advantage of this method over the more conventional method of manually mounting imaged segments is the improved register and decreased mounting cost. The second method however is less popular than the manual mounting method, mostly because of cost. Producing imaged flat flexographic plate sheets for is relatively inexpensive because the equipment is widely available and its cost mostly amortized. There is substantial investment required for exposing flexographic plates "in the round," i.e., on blank segments mounted on cylindrical carriers.

One of the problems with using a plurality of segments is accurate registration. As a result, imaging on a single sheet is still often used in flexography, even at the cost of the wasted plate material.

Thus there is a need in the art for an apparatus and method of producing print-ready cylinders by first exposing flat plate materials and cutting the flat plates into segments, while maintaining register accuracy that does not depend on the skill of the operator to the same extent as the known manual method. There further is a need in the art for a mounting device that provides for mounting exposed plate segments onto a plate carrier while maintaining accuracy, such a device being considerably less expensive than a full "in the round" processing unit.

SUMMARY

Described herein is a method and an apparatus for mounting printing plate segments onto a printing plate carrier. In one embodiment, the printing plate carrier is on a cylindrical drum, i.e., is a cylindrical plate carrier, while in another embodiment, the carrier is a sheet laid out on a substantially flat surface that, after mounting, can be placed on a drum.

The method includes accepting positioning data indicative of a set of first positions and loading the imaged segments onto a working surface of the loading table at approximately the corresponding first positions. The method further includes, for each segment, detecting the position of the segment on the table, and using a mechanical pick-up system to pick up the segment and to carry the segment to a final position on the carrier. The carrying is via a path determined using the detected position on the table and the final position. In one embodiment, the table's working surface has a set of vacuum holes coupled to a vacuum system. The mechanical pick up system includes a plurality of suction caps coupled to the vacuum system to pick up the plate. One version includes a mechanism for cutting the segments from the sheet.

In one embodiment, the mechanical pick-up system includes one or more pick-up arms. Each arm is rotatably connected to the loading table and has one or more suction caps coupled to the vacuum system. For example, one version has four pick-up arms. Each arm has a head that is movable lengthwise along the arm. The head includes a video camera and a single suction cap coupled to the vacuum system.

In one embodiment, each imaged plate segment has a plurality of register points. The detecting of the position of the segment detects the register marks. The detecting uses the video detecting system, e.g., the cameras mounted on the arms of the mechanical pick-up system in the version that has such arms. The picking up includes positioning the pick-up system such that the suction caps are close to the detected positions of the register marks, such that the picking up is at pick-up points close to register marks. The carrying of the segment includes initially rotating the cylindrical carrier so that the location on the carrier of the roll-off point of the segment is such that the mechanical pick up system can place the roll-off point of the segment thereon. The roll-off point is a point on the final position of the segment. The method includes carrying the segment such that the segment's roll-off point can be placed on the location on the carrier of the roll-off point, placing the segment's roll-off point onto the roll-off point location on the carrier, and placing the remainder of the segment on the carrier by translating the mechanical pick-up system and simultaneously rotating the cylinder such that the segment ends placed at its final position.

In one version, no deformation of the segment can occur during the carrying. In another version, the method includes picking up each plate segment at more than two independent points and carrying each segment to a respective final position on the carrier, such that some of the plate segments may need to be deformed to reach their respective final position. For a plate segment that is so deformed, the final position cannot be reached by picking up the plate segment at only two points because of the required deformation of the plate.

The apparatus includes a computer system to control the various elements and functions such as the motion of the mechanical pick-up system, the detection of position by the video detection system, and the determining of the path for carrying the plate segments.

DESCRIPTION OF THE PREFERRED EMBODIMENTS

Described herein is a method for mounting imaged printing plate segments onto a printing plate carrier, and an apparatus for such mounting. The method and apparatus can be used to create cylindrical plate carriers such as printing drums, cylindrical printing sleeves or mylar sheets that may be wrapped around a printing drum. The plate carriers contain segments of printing plate material, mounted such that the plate segments are registered with respect to each other on the same carrier, and such that when a set of cylindrical plate carriers is used to print a set of inks onto the same substrate, the plate segments on one carrier are registered relative to the plate segments on the other cylindrical plate carriers.

Figure 1A:
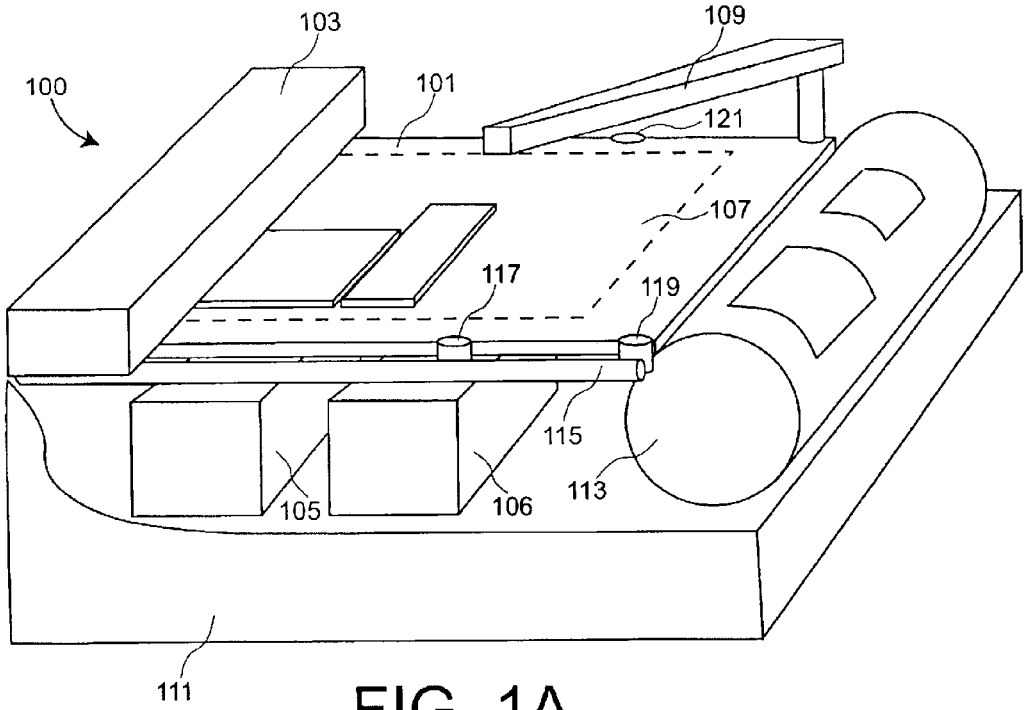
FIG. 1A shows one embodiment of a mounting device according to an aspect of the invention.

FIG. 1A shows one embodiment of a mounting device 100. The device includes a base 111 and a substantially planar loading table 101 attached to the base 111. The base 111 is shown cut-away and details of how the components are coupled to the base are not shown for the sake of clarity. Part of the planar loading table is the working surface 107. The loading table includes a set of vacuum holes (see FIG. 2) to force printing plate material to be attached to the loading table when a vacuum is applied. The vacuum holes are coupled to a vacuum system 106 that can be switched on or off under control of a computer system 105.

Figure 1B:
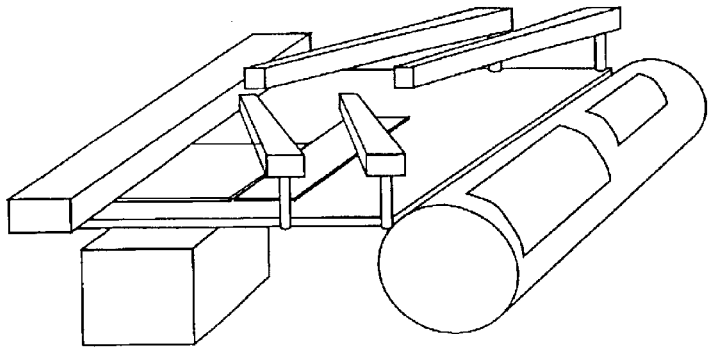
FIG. 1B shows a partial view of the embodiment of FIG. 1A with a mechanical pick-up system that includes four pick-up arms.

The mounting device further includes a mechanical pick-up system. One mechanical pick-up system embodiment includes a set of robotic pick-up arms rotatably coupled to the table 101, either by a direct rotatable connection to the table 101, or, in another embodiment, by a rotatable connection to the base 111 to which the table 101 is connected. The apparatus further includes a video detection system that in one embodiment includes a video camera on each pick-up arm. Each pick up arm has a pick-up mechanism that includes at least one suction cap coupled to the vacuum system 106. One pick-up arm 109 is shown in FIG. 1A. In this embodiment, three other pick-up arms are located at locations 117, 119, and 121. FIG. 1B shows all four pick-up arms. The video camera of each pick-up arm is interfaced to the computer system 105 to provide an optical recognition system for a set of locations.

Figure 3:
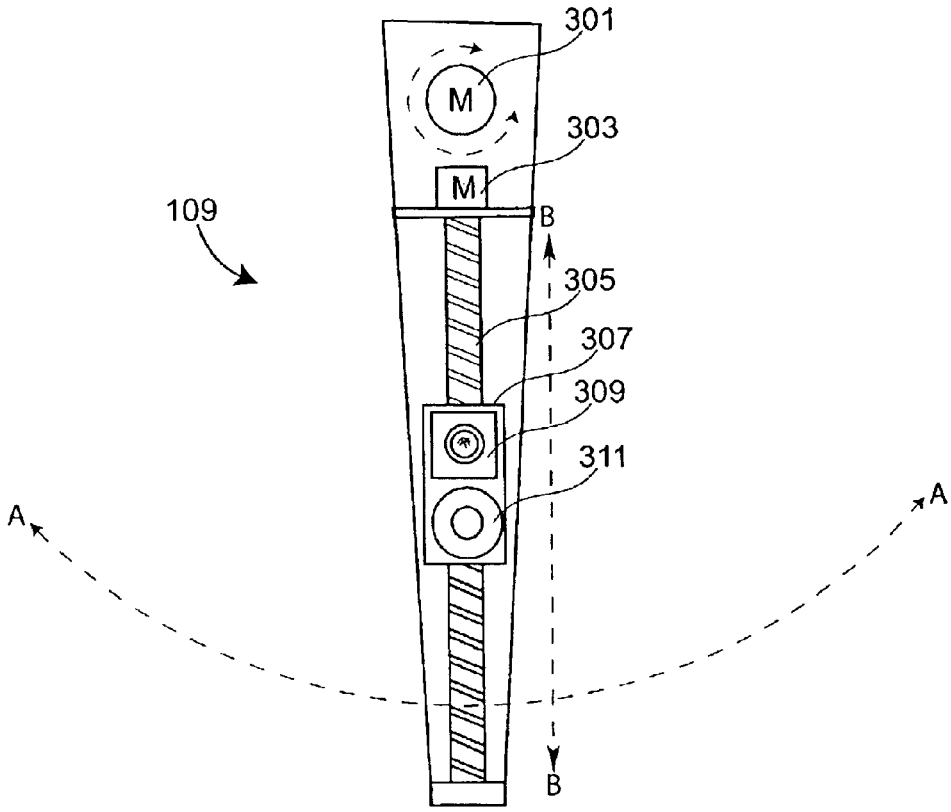
FIG. 3 shows an embodiment of one of the pick-up arms of the mounting device of FIG. 1A.

FIG. 3 shows one embodiment of the robotic pick-up arm 109 in more detail. The arm 109 is rotatably coupled to the table, e.g., by being rotatably attached to the base 111. A motor 301 and motor control system connected to the computer system 105 provide for the arm to rotate under control of the computer system 105. The approximate range of rotation is shown as AA. The suction cap pick-up mechanism is shown as 311 and the video camera is shown as 309. Both the suction cap and the camera system are mounted on a head 307 that moves along the arm, also under control of the computer system 105. In one embodiment, the motion of the head uses a lead screw 105 and a second motor 303 with a control system connected to the computer system 105. The approximate range of motion along the arm 109 is shown as BB. In another embodiment, a linear motor provides the motion along of the head along the arm. See U.S. Pat. No. 4,543,615 to Van Campenhout, et al. for a description of a linear motor. U.S. Pat. No. 4,543,615 is incorporated herein by reference.

The suction cap of pick-up mechanism 309 is movable towards or away from the loading table under control of the computer system. In this manner, under computer control, the suction caps of the robotic pick-up arms may be positioned to be on top of a desired location on the loading table surface 107 on which a plate segment was placed, and lowered to make contact or almost make contact with the plate segment. The vacuum can then be turned on (under control of the computer system) so that the pick-up mechanism's suction cap attaches itself to any plate material on the loading table. Using the four pick-up arms thus provides a mechanical pick-up system that can pick up by using a plurality of suction caps at a plurality, e.g., up to four locations. The vacuum applied to the loading table's vacuum holes is selected to be low enough relative to the vacuum used on the arms' suction caps so that a set of suction caps applied to a plate material segment can remove the plate material segment from the loading table.

One embodiment includes a pneumatic system coupled to each arm's pick-up mechanism 309 to move the pick-up mechanism 309 towards or away from the loading table under control of the computer system. In another embodiment, each pick-up arm is movable towards or away from the loading table.

Thus the computer system 105 can direct the video cameras and the suction caps of the pick-up arms to a set of locations on the working surface 107 of the loading table 101. In one embodiment, positioning the arm is relative to the loading table surface that provides a frame of reference.

The device 100 also includes a cutting bridge 103 across the loading table (the y-direction) with a cutting knife mechanism. The cutting bridge 103 includes a motor and motor control mechanism that can move the bridge 103 along the loading table on two rails in the x-direction perpendicular to the bridge under control of the computer system 105. One such rail 115 is shown in FIG. 1A. The bridge further includes a motor and motor control mechanism connected to the cutting knife mechanism to move the cutting knife mechanism along the length of the bridge under control of the computer system 105 so that by a combination of movement of the bridge along the loading table and the cutting knife mechanism along the bridge, the computer 105 can direct the cutting knife mechanism to any location in on the loading table surface. A further motor and control system directs the cutting of any plate material placed on the loading table.

One embodiment uses a commercially available cutting loading table system for the cutting bridge 103 and the cutting knife mechanism and all motors and control systems fir the bridge and cutting mechanism. The commercially available cutting loading table system is the Kongsberg XL cutting loading table range made by Esko-Graphics NV, of Belgium (formerly Barco Graphics NV), the assignee of the present invention. A brochure describing the Kongsberg XL cutting loading table is available in the Web at http://unix.barco.com/graphics/kongsberg/XLloading tables.htm and incorporated herein by reference. The control system software of the Kongsberg XL is included in computer system 105.

Cutting information may be transferred to the cutting loading table control system to control the cutting of a sheet of plate material placed on the loading table.

Figure 2:
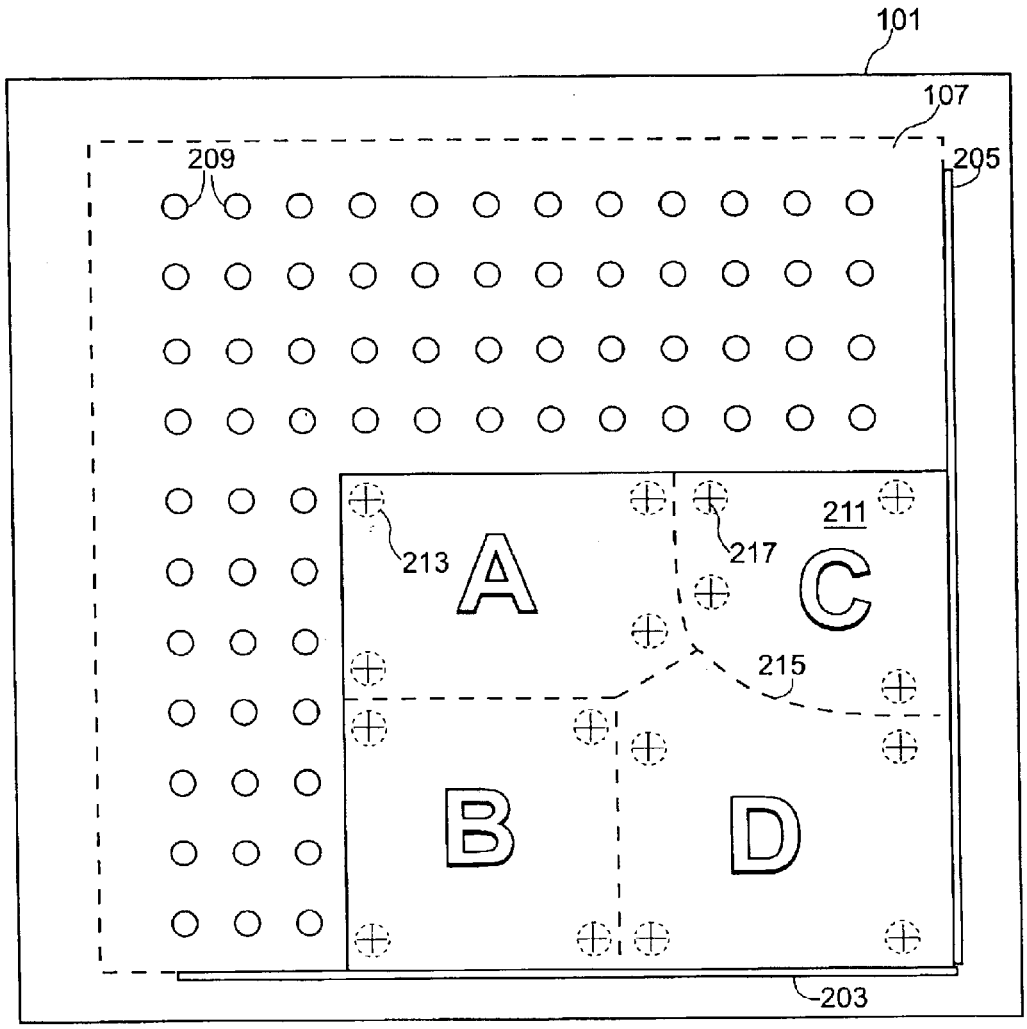
FIG. 2 shows a top view of the one embodiment of the loading table of the mounting device of FIG. 1A, including the working surface and a sheet of plate material on the surface.

FIG. 2 shows a top view of the loading table 101 including the working surface 107 within the dashed lines. Two of the vacuum holes are shown as having reference numeral 209. In one embodiment, the loading table includes two alignment edges 203 and 205 in the x- and y-directions, respectively used as registration guides. When a sheet of plate material is placed along the alignment edges, the alignment edges provide for rapidly aligning the sheet so that there is approximate registration relative to the loading table frame. Such approximate registration, for example, positions a sheet to within 1 mm in one or both of the x and y-directions relative to the positions of the alignment edges, and to less than 2 degrees error in rotation. FIG. 2 shows a flexographic plate sheet 211 positioned against the alignment edges. The dashed lines 215 show a cutting path for the cutting knife. The sheet shown has four imaged segments. Each segment includes four registration marks such as mark 217. On each segment, the dotted lines such as line 213 show the locations where the four suction caps of the pick-up mechanisms on the four arms are positioned to pick up and move the plate segments after cutting (see below). The set of printing plate segments on the sheet is maintained on the surface 107 be the vacuum being turned on to the vacuum holes.

The loading device 100 further includes a clamped cylindrical drum 113 that can rotate around its axis. The axis of rotation is parallel to the y-direction. In one embodiment, the drum is adapted to fit a plate carrier for mounting flexographic plate material thereon. The plate carrier is mounted on the drum. Thus, a sleeve is mounted on the drum, or a mylar sheet is rolled onto the drum, and so forth. The drum system includes one or more motors and an associated motor control system coupled to the computer system 105. Rotation of the drum, i.e., of the plate carrier, is controlled by software in computer system 105.

In one embodiment, the working surface 107 of the loading table is approximately 90 cm (in the x-direction) by 120 cm wide (in the y-direction). Such a load device may be used, for example, for printing cylinders of up to 120 cm in width. Such cylinders may be used, for example, for high quality printing of packaging material such as flexible packaging and folded cartons. A second embodiment accommodates printing cylinders of up to 240 cm in width. In such a case, the working surface 107 is approximately 160 cm (in the x-direction) by 240 cm wide (in the y-direction).

The computer system 105 includes a user interface. The computer system also includes the necessary control logic interfaced to the various motor drives and motor control systems, to the cutting knife, to the vacuum system 106, and to the video cameras such that the combination of a video camera, interface, and software on computer system 105 forms an optical recognition system.

Operation of the mounting device 100 is described herein for the case of flexographic plate segments being mounted onto an adhesive sleeve such as a McDermid Twinlock sleeve (MacDermid Printing Solutions, LLC, Atlanta, Ga.). The mounting system is easily adapted to other printing plates, not just flexographic plates, and to other types of printing plate carriers.

Figure 4:
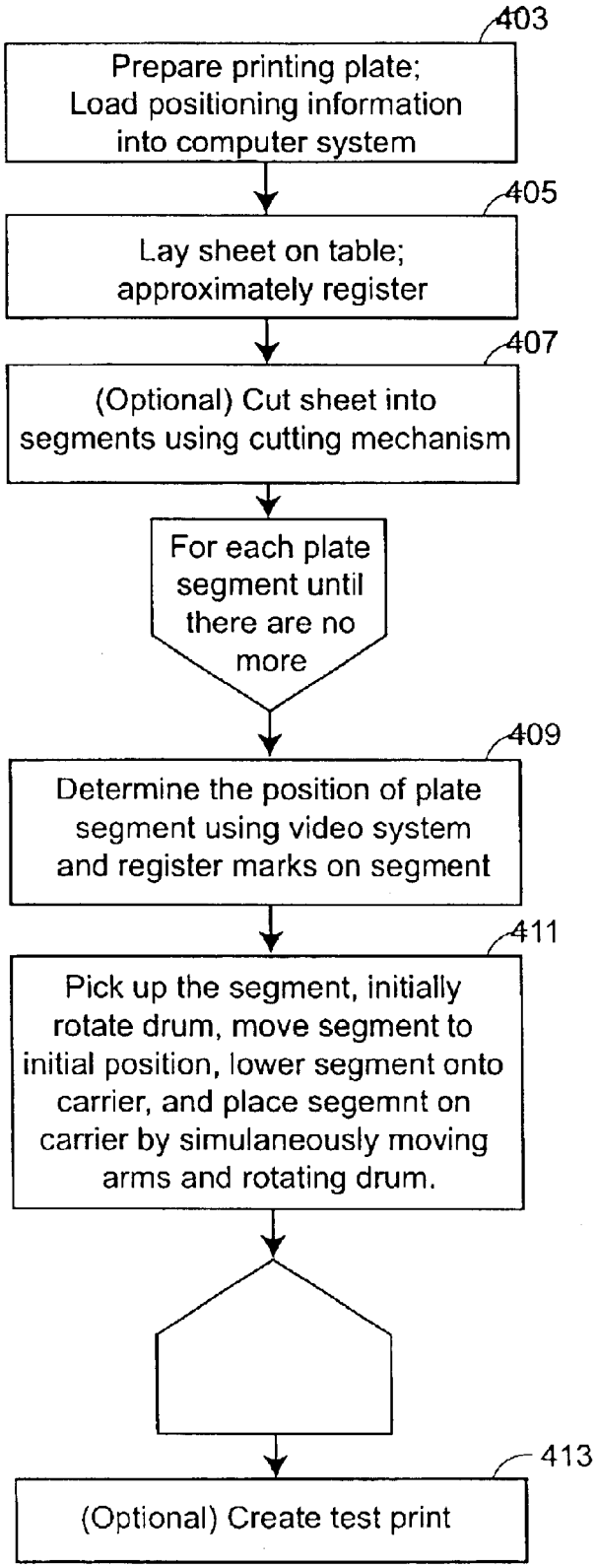
FIG. 4 shows a flow chart of one embodiment of a method of mounting plate segments on a plate carrier.

FIG. 4 shows a flow chart of one embodiment of a method 400 of mounting plate segments using an embodiment of the mounting device 100.

The method starts at step 403 with producing printing plate sheets. This can use any conventional method and results in imaged sheets of flexographic plate. Each sheet can contain one or multiple parts (segments) of one or multiple separations. In one embodiment, the printing plate sheets are produced in a manner that reduces waste using the imaging method described in above-mentioned incorporated-by-reference U.S. patent application Ser. No. 09/946,145 to Klein, et al. The Klein, et al. imaging method includes processing full-format screened data in a computer to identify zones that contain printable information. The zones are packed, imaged onto a set of printing plate sheets, e.g., one sheet for each separation so that each sheet may be cut into flexographic plate segments. The method includes imaging a set of register marks for each segment. U.S. patent application Ser. No. 09/946,145 is incorporated herein by reference.

The positioning data for the segments, including the position of the register marks for each segment, the cutting path for cutting each sheet of plate material into segments, and the location of the segments on a printing sleeve, is transferred to computer system 105. Thus, at the end of step 403, the computer system 105 contains information on where each printing plate segment is to be placed on a printing sleeve (the respective final position) and where each segment is located in the printing plate sheet prior to cutting.

In a step 405, the sheet of printing plate material containing the flexographic plate segments is laid on the loading table against the alignment edges 203 and 205 (see FIG. 2). In this manner, plate can be approximately registered with respect to the mounting system, e.g., with less than 1 min error in position and less than 2 degrees error in rotation. Once the plate is laid against the alignment edges, the vacuum system 106 is turned on so that the vacuum applied to the vacuum holes maintains the sheet in position on the working surface.

In a step 407, the cutting knife mounted on cutting bridge 103 cuts the sheet into individual segments along a cutting path (dashed lines 215 in FIG. 2). The cutting path 215 is determined by the computer system (part 105) using information obtained during the imaging and loaded into computer system 105. As a result of cutting, a plurality, denoted N of flexographic plate segments are on the loading table positioned at their initial location, i.e., approximately registered.

The following steps 409 and 411 are executed for each plate material segment sequentially until there are no more segments. The steps are described for one plate segment, and are identical for the other segments.

In a step 409, the location of the flexographic plate segment is determined using the video detection system. The computer system includes information on the relative locations of the register marks on the segment relative to the sheet of plate material, hence the approximate location of the flexographic plate segment is known. The segment includes a set of register marks. In one embodiment, the register marks each have a cross form and are positioned near the outside border of the segment of plate material. The locations of such a mark is detected. The corresponding location of the register mark on the final printing plate carrier is stored in the computer system 105.

Figure 5A:
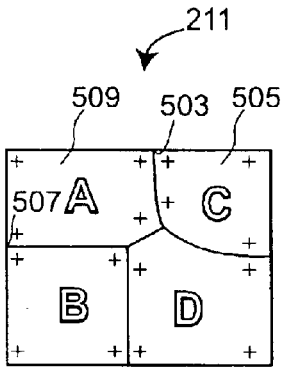
FIG. 5A shows a sheet of plate material with cut segments of plate material in an initial position.

FIG. 2A shows a simple example of four plate segments that each includes an image and four register marks. FIG. 5A shows the same segments in their initial position.

As part of step 409, the pick-up arms move to positions such that each arm's video camera is approximately over a register mark. Thus, each register mark—up to the number of pick-up arms—is in a video camera's field of view. The video information is input to the computer system 105 and the register mark is recognized in order to determine the exact position of the register mark. Because step 2 positions the segments approximately, e.g., to within one mm in each orthogonal direction, the video registering system can limit its search in a small region around theoretical position.

Figure 6:
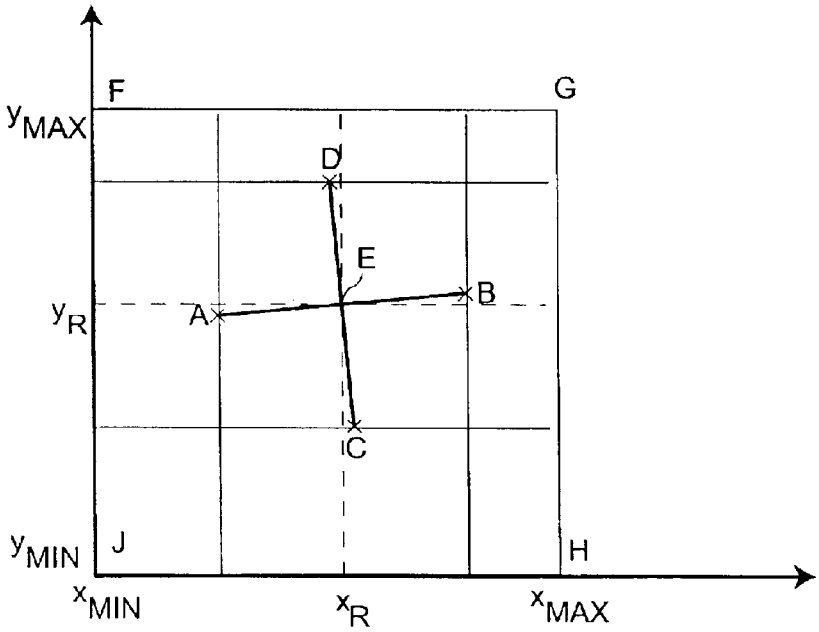
FIG. 6 shows the region around a single register mark according to an embodiment of the invention.

FIG. 6 shows the region around a single register mark. For each register mark, a search is made over an area FGHJ between $x_{MIN}$ and $x_{MAX}$ in the x-direction, and $y_{MIN}$ and $y_{MAX}$ in the y-direction. The distances $(x_{MAX}-x_{MIN})$ and $(y_{MAX}-y_{MIN})$ are related by the accuracy of loading the sheet, e.g., the register mark length +2 mm in the x- and y-directions, respectively. The mark preferably consists of two crossed lines, with the register point being the intersection of the lines. The register marks are located far enough away from any image on the plate such that no image data is present within the register mark search region.

As part of step 409, image of the region around the register mark is digitized and analyzed by computer system 105. The edge locations are determined in one embodiment by a simple edge enhancement and scanning process for edge detection. The enhanced image data is canned in the x- and y-directions to determine a set of x-values and y-values for the edges in each register mark. Each x-position is scanned up (increasing y) and down (decreasing y) to yield a pair of y-values for the edge. The average of the y-values for scanning up and down is determined as the register mark location. Thus one or two edge locations are determined at each x-value. Similarly, one or two edge locations are determined for each y-value. Thus, two lines AB and CD are determined (see FIG. 6). The intersection of the two lines, shown as E, can then be determined for each register mark. The register mark data is in the form of coordinates $x_R$ and $y_R$.

This operation is repeated for each register mark of each segment to determine the coordinates of each register mark. As a result, the position of the plate is known, needing only the coordinate of one register mark. Once the location of a second register mark is known, the rotation of the plate segment also is known.

One embodiment assumes no deformation, e.g., stretching of the plate segment occurs. An alternate embodiment assumes deformation can occur. The locations of more than two register marks are used to determine the deformation.

Once the locations of the register marks of the segment are determined, up to four suction caps are lowered to pick up the segment. In one embodiment, each arm is moved so that each suction cap is approximately at the location of a register mark. This is preferred because the region around each register mark is known to be free of printing information, so is flat. This permits the suction cap to pick up the plate without damaging the plate.

Referring again to FIG. 2, in one embodiment, the dimensions of the block on which the pick-up mechanism and video camera are mounted is such that the minimum distance between the pick-up suction caps of any two arms is about 10 cm. Thus, segments of any shape that are wider and taller than 10 cm, four register marks may be used, and the all four pick-up arms can be used to pick up the segment. For smaller segments as few as a single pick-up arm may be used, and typically two or more pick-up arms are used.

Thus, in a step 411, the suction caps of the pick-up mechanisms are moved over the register marks and lowered. The vacuum is turned on for each pick-up mechanism on each arm so that the segment is locked onto the set of arms. Recall that the vacuum applied to the pick-up arm's suction cap is selected to produce a force higher than that applied at the vacuum holes on the loading table surface. Thus a set of suction caps applied to a plate material segment can remove the plate material segment from the loading table after the vacuum is turned on.

The set of pick-up arms together now pick up the segment of printing plate by lifting the suction caps with the vacuum on. The plate is typically kept horizontal. The set of arms together move under computer control to carry the plate segment to the correct position on the drum on which a printing plate carrier is held.

Figure 5B:
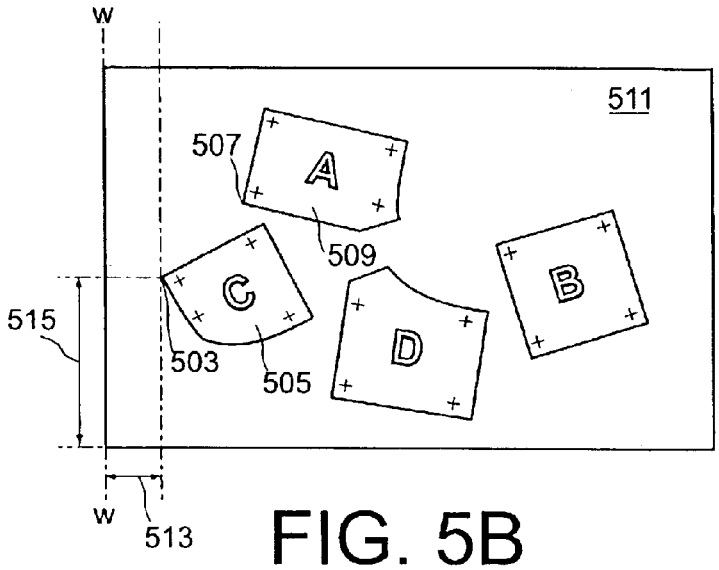
FIG. 5B shows the plate carrier unrolled with the segments of FIG. 5A after mounting at the correct positions.

The paths for the four arms are determined on the computer system 105 so that each register mark ends up at the correct position on the carrier. Each path includes translation of the arms in a manner that (1) rotates the segment to the correct orientation, and (2) moves the so-called "roll-off point" on the segment to the position immediately above the axis of rotation of the drum at the correct y-position of the roll-off point. The roll-off point is the point of the segment that would be the last point touching the drum surface if the plate segment was correctly positioned and was to be removed in a first direction, e.g., counterclockwise. That is, if the drum with the segment correctly placed was to be rotated in the first direction, e.g., counterclockwise, the roll-off point would be the first point that would be above the axis or rotation of the drum. FIG. 5A shows the exposed plate 211 (FIG. 2) after cutting. FIG. 5B shows the carrier unrolled with the plate segments of plate 211 correctly placed. FIG. 5B shows exaggerated rotation of the segments to the correct orientation. The roll-off point on any segment when the first rotation direction is counterclockwise is the point on the segment with the least x-value on the unrolled carrier. Consider segment 505—the segment with "C". The counterclockwise roll-off point is the top left-hand corner 503. The motion of the arms is such that point 503 is moved to be on top of the axis of the drum at the correct y-position shown as distance 515. Similarly, consider segment 509 that has an "A." The path of the arms is calculated so that segment 509 is rotated to its correct orientation and so that point 507 (the counterclockwise roll-off point) is moved to be above the axis of rotation at the correct final y-position of point 507.

For each path, the rotation of the drum in the first direction also is determined so that the roll-off point is located above the axis of rotation.

How to so determine the paths for the simultaneous motion of the arms is well known in the field of robotics. In the embodiment in which no deformation is assumed, the paths are calculated so that the segment of plate material is not stretched, i.e., the distance between the suction caps on the pick-up arms is maintained constant throughout the motion. In embodiments in which deformation also is corrected for, the distance between the suction caps is modified during the motion to correct for any stretching or other deformation that may have been determined.

Once the paths are determined, for each segment, the drum is rotated in the first direction, e.g., counterclockwise so that the roll-off point is above the axis of rotation, and the arms are moved to rotate the segment to the correct orientation and move the segment so that the roll-off point is above the axis of rotation of the drum at the correct position along the rotation axis. The plate is now brought down until the roll-off point touches the drum. Thus, the roll-off point, e.g., point 503 in the case of segment 505 now sticks to the carrier on the drum. In one embodiment, the whole carrier is adhesive. The drum is now rotated in the direction such that the segment is laid down on the surface of the carrier, e.g., clockwise while the arms simultaneously move so that the segment is translated at a speed that is matched to the rotation of the drum. The rotation of the drum and simultaneous translation of the segment continues until the whole segment adheres to the carrier on the drum. The vacuum is released as each suction cap passes over the axis of rotation of the drum.

The motion of the arms and drums for each segment, including the picking up of each segment from the working surface 107 of the loading table, the rotation and translation of the segment to the intermediate position so that the roll-off point is above the rotation axis, the initial rotation of the drum, the lowering of the segment onto the drum, and the rotation of the drum simultaneous with the motion of the arms and release of the suction caps is controlled by executing real-time control software on computer system 105 based on the determined paths and motions.

The method repeats steps 409 and 411 for each segment that is to be mounted on the plate carrier. In some applications, the one carrier may include segments from more than one sheet of plate material. In such a case, step 405 and 407 are repeated for any additional sheets needed for the one plate carrier.

The method results in a plate carrier, e.g., a sleeve in the drum carrying the segments correctly placed for a separation.

In an optional step 413, the newly created printing plate carrier is used to make an impression on a sheet of substrate, e.g., paper mounted on a second drum, or in an alternate embodiment, on a second loading table at the other side of the printing drum. One embodiment of optional step 413 includes inking the plate with the corresponding ink. Such inking may be carried out manually with a hand roller. Alternatively, an automatic inking system may be used. Automatic inking systems are known in the art. For example, proofing systems for flexographic plates that include automatic inking systems are known in the art, and such an automatic inking system may be adapted to use in the mounting system described herein.

Once a test print has been made, the plate carrier—the drum sleeve or mylar sheet the drum—is removed from the device 100 and is ready for use in printing. The next printing plate carrier can now be loaded. A new plate sheet can be loaded or the remainder of the previous sheet can be used, as required.

Alternate Embodiments

Loading onto a Laid Out Sheet

Figure 7:
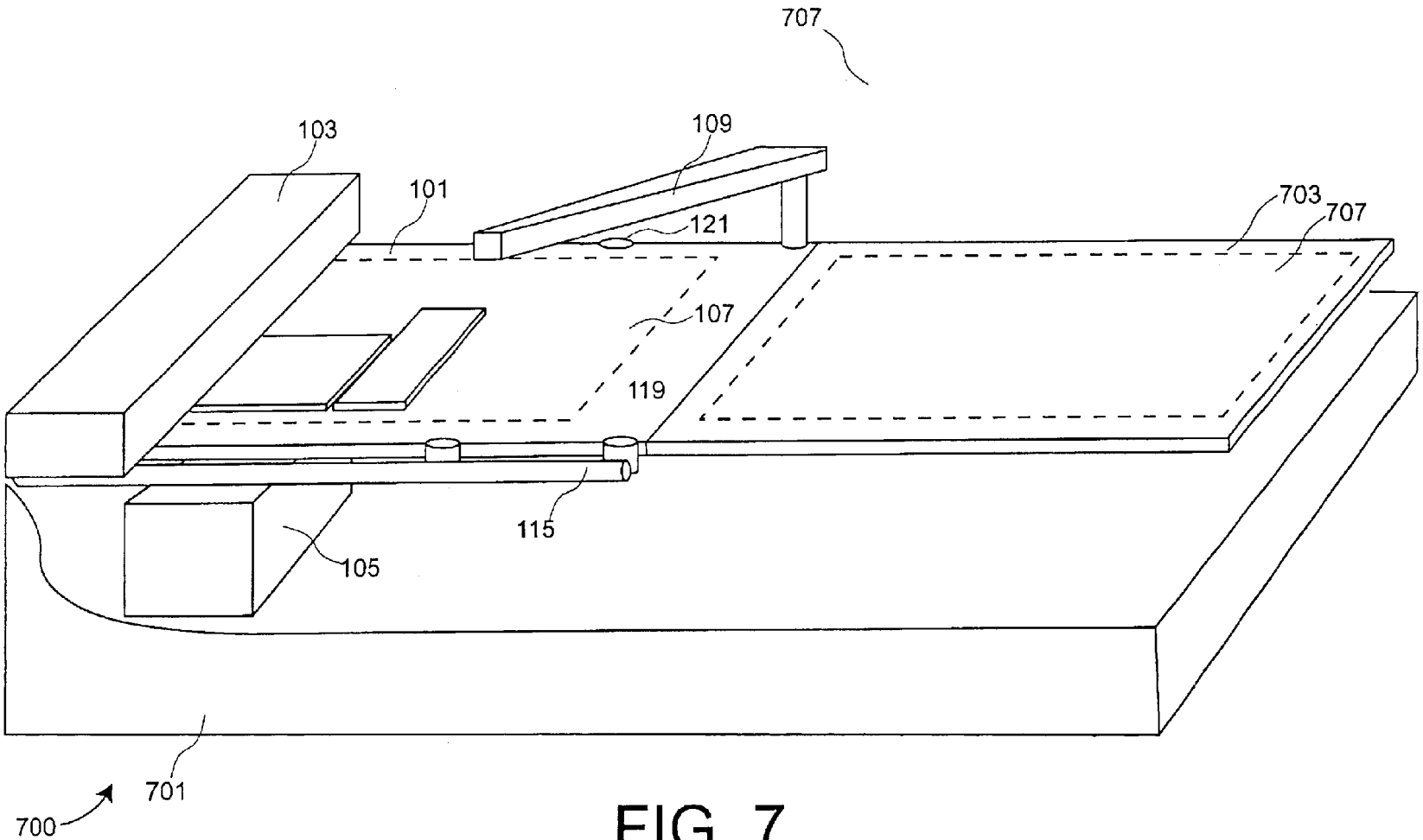
FIG. 7 shows an alternate embodiment of the mounting device that mounts onto a laid out sheet such as a mylar sheet.

While one embodiment loads the segments onto a cylindrical plate carrier, such as a sleeve, a printing cylinder, or a mylar sheet rolled onto a drum, another embodiment loads the segments onto a substantially flat sheet, e.g., a mylar sheet that can later be mounted on a cylinder. Such an embodiment is shown in FIG. 7. The drum 113 of FIG. 1 is replaced by a flat surface 707 on an extension table 703 onto which the sheet carrier can be loaded. In one embodiment, the surface 707 includes vacuum holes coupled to the vacuum to hold the sheet onto the surface. The carrying of each segment using the mechanical pick-up system to the particular segment's corresponding final position on the carrier is then simpler for the case of the laid out sheet carrier because the combined motion of a drum and the pick-up system is not required.

Adhering the Plate Segments to the Plate Carrier

While one embodiment uses an adhesive sleeve such as a McDermid Twinlock sleeve that is adhesive at the time the plate segment is placed on it, an alternate embodiment uses plate segments that are adhesive. One embodiment of step 411 includes applying an adhesive after the plate is lifted from the loading table and before the plate segment is lowered onto the plate carrier. One version of step 411 includes automatically applying the adhesive. An embodiment of the mounting system includes a gluing system that uses a gluing roller coupled to the computer system 105 and located between the plate sheet location and the drum so that adhesive is applied under control of the computer system after the plate is lifted from the loading table and before the plate segment is lowered onto the plate carrier.

Another version of the method includes applying adhesive by hand.

According to another implementation, only the areas of the plate carrier that are to receive printing pate segments are made adhesive, thus saving on adhesive material. These areas of the sleeve can be outlined with an inkjet printing system. U.S. Pat. No. 5,846,691 issued Dec. 8, 1998 to Cusdin, et al. describes how this may be carried out for the case of non-imaged flexographic plates. How to modify the Cusdin, et al. method for the present invention would be straightforward for those skilled in the art. U.S. Pat. No. 5,846,691 is incorporated herein by reference.

Alternate Embodiment Providing for Arbitrary Rotation of Plate Segments

One embodiment of the mounting device is suitable for multi-ink printing of screened images. In such a case, the screen directions need to be accurate relative to each other. Thus, in one embodiment of step 403, the plate segments are imaged in the same direction. The packing is such that all plate segments are oriented the same way, or rotated ±90°.

In one embodiment of step 411, each segment needs to be rotated either by a relatively small amount, e.g., in the range of −3 to +3 degrees, to account for misplacement on the table, or by an angle close to 90 degrees, e.g., 87 to 93 degrees or 93 to −87 degrees. The embodiments shown in FIGS. 1A and 1B are aimed at rotating by a small angle. If rotation by an additional ±90° is desired, the individual pieces would need to be rotated manually. Each of the pickup arms then, in the step 409, determine the position of plate segment using the video system to detect the position of the register marks on the segment.

Figure 8:
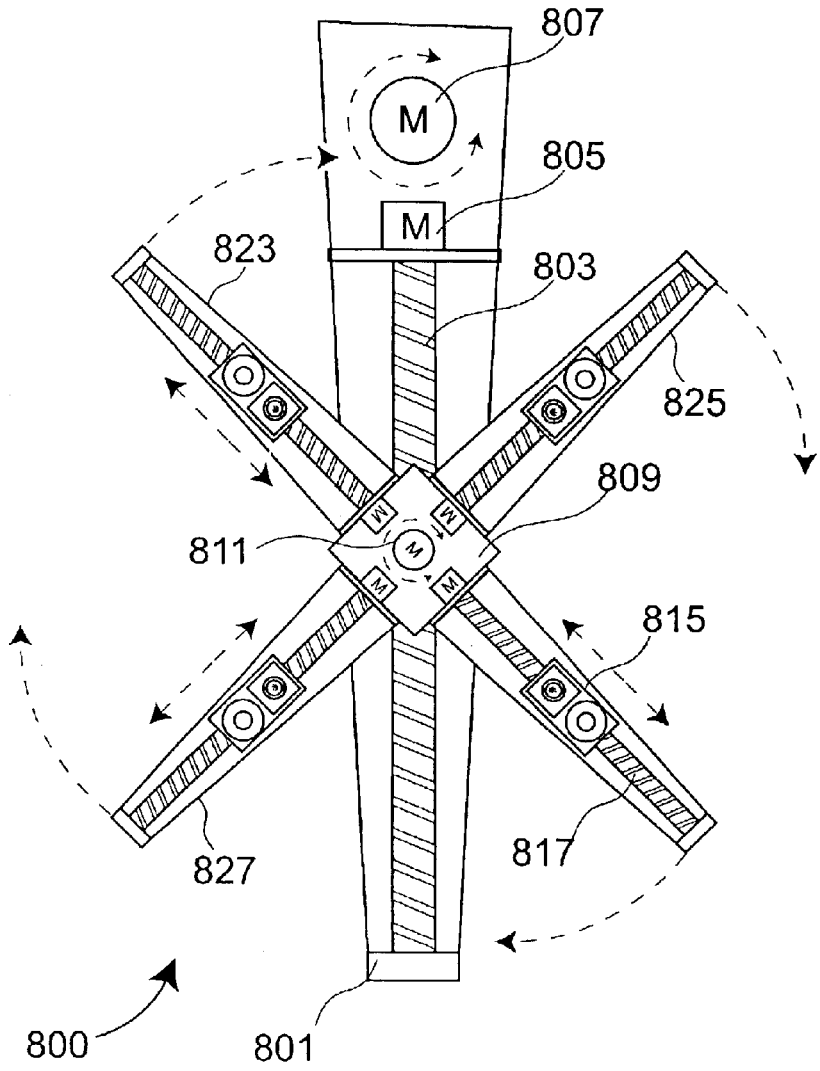
FIG. 8 shows an alternate embodiment of a mechanical pick-up system that has a single pick-up arm including a head on which are mounted four limbs with each limb having a movable head with a camera system and suction cap thereon.

FIG. 8 shows an alternate pick-up arm system 800 for the mounting device. The mounting device uses only a single pick-up arm system 800. The system 800 includes an arm 801 rotatably mounted to the table, e.g., by being rotatably attached to the base 111. A motor 301 and motor control system connected to the computer system 105 provide for the arm 801 to rotate under control of the computer system 105. A head 809 moves along the arm 801 using a lead screw 105 and a second motor 303 with a control system connected to the computer system 105. An alternate embodiment uses a linear motor for the motion of the head. An assembly having four limbs 813, 823, 825, and 827 at forming an "X" is rotatably attached to the head 809 and can rotate using a motor 811 coupled to the computer system 105. In one embodiment, each of the limbs is identical. Consider limb 813. Limb 813 includes a head 815 on which is mounted a suction cap pick-up mechanism and a video camera. The head 815 is movable along the limb 813, also under control of the computer system 105. In one embodiment, the motion of the head uses a lead screw 817 and yet another motor, with a control system connected to the computer system 105.

An alternate embodiment has head 809 mounted on a bridge across the loading table (the y-direction) that includes motor and motor control mechanism that can move the bridge along the loading table in the x-direction perpendicular to the bridge under control of the computer system 105 on two rails. The head moves along the bridge under control of the computer system.

Both the single arm and single bridge embodiment that includes the head of four limbs provides for rotating the plate segment any arbitrary angle once the plate segment is picked up.

An improved embodiment applicable to the single arm and the bridge configurations has pairs of limbs on the hear 809 be co-linear, and allows the pairs of limbs to rotate with respect to each other. Referring to FIG. 8, an additional motor and motor control system coupled to the computer system are includes to permit co-linear limbs 813 and 823 to rotate independently of co-linear limbs 825 and 827. That provides 4 arbitrary pick up points.

Thus, a method and apparatus has been described that should be more accurate than mounting plate segments with a manual mounting machine. The mounting method and operation of the mounting device depend less on hand operation and operator skill than the manual method. The accuracy is determined by the mechanical precision of movement of the robotic pick-up arm (or bridge in alternate embodiments). State-of-the-art robotics provides movements that are more precise and more repeatable than manual operations.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Description of the Preferred Embodiments are hereby expressly incorporated into this Description, with each claim standing on its own as a separate embodiment of this invention.

It should further be appreciated that although the invention has been described in the context of flexographic plates, the invention is not limited to such contexts and may be utilized in various printing applications and systems, for example in a system that uses other kinds of plates. The method can be used, for example for letterpress plates, rubber plates, and for varnish blankets.

While one embodiment uses at most four pick-up points, fewer or more pick-up points may be used in alternate embodiments. More than two pick-up points are required for accurate placements of more than two register point that allows for deformation of the segment.

One embodiment includes a video camera mounted in each pick-up arm. The video camera is positioned over a register mark and an image taken and input to the computer. The video camera may be a CCD camera, but this aspect the invention does not depend on the type of camera used. Software in the computer system then determines the position of the register mark.

In an alternate embodiment, the video detecting system used to detect the position of each segment's the registration marks includes a laser scanner rather than a video camera on each pick-up arm. The laser scanner includes a laser source and laser detector. The region around each register mark is optically scanned to determine the location of the lines of each register mark.

While one embodiment holds one plate sheet at a time on the loading table, an alternate embodiment of step 405 lays a plurality of printing plate sheets on the loading table 101 at different positions. FIG. 1A, for example, shows two plate sheets. As long as each of these sheets is laid down with approximate registration so that the computer system 105 knows the approximate position, e.g., to within 1 mm in the x- or y-directions, the different plate segments are handled one by one sequentially, fully under control of the computer system 105, as described above.

Reference herein is made to the computer system 105. The term computer system is used herein to indicate any device or system for controlling the devices such as the mechanical pick-up system. Thus, the term includes special purpose controllers, and other special purpose devices. The system 105, for example, need not even include a traditional computer.

By "cylindrical" plate carrier is meant a sleeve or a printing cylinder, etc., or a sheet such as a sheet of mylar that has been wrapped around a cylinder.

The term "rotatably coupled to the loading table" includes, for example when applied to a pick-up arm the case that the table is connected to a base and that the pick-up arm is rotatably connected to the base. No direct connection between the table and the arm need occur, although the term includes such a case.

The terms "includes" and "including" are synonymous with "comprises" and "comprising," respectively.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention.

I claim:

1. A method for mounting printing plate segments on a printing plate carrier, the method comprising:

accepting positioning data indicative of a set of first positions, each first position being the position on a loading table of a corresponding plate segment of a set of imaged printing plate segments;

loading the set of imaged printing plate segments on the loading table, each at approximately the corresponding first position on the loading table;

accepting positioning data indicative of a set of final positions, each final position being the position of a corresponding printing plate segment on the printing plate carrier; and for each segment of the set of segments, detecting the position of the segment on the loading table;

picking up the segment using a mechanical pick-up system; and carrying the segment using the mechanical pick-up system to the particular segment's corresponding final position on the carrier, the carrying via a path determined using the detected position on the table and the corresponding final position.

2. A method as recited in claim 1, wherein the printing plate carrier is a cylindrical plate carrier.

3. A method as recited in claim 1, wherein the printing plate carrier is a laid out sheet and the carrying of each segment in on to corresponding final position on the laid out sheet.

4. A method as recited in claim 1, wherein the table includes a substantially flat working surface that has a set of vacuum holes coupled to a vacuum system, and wherein the loading of the set of imaged printing plate segments loads one or more sheets onto the table, the loading including turning on the vacuum to the vacuum holes so that the set of segments is maintained on the working surface.

5. A method as recited in claim 1, wherein the table includes a substantially flat working surface, wherein the set of imaged printing plate segments are on a sheet of plate material, and wherein the loading loads the sheet of plate material onto the loading table surface, the method further comprising:

cutting the segments of the set of segments from the sheet using a cutting mechanism, based on cutting paths.

6. A method as recited in claim 1, wherein the detecting the position of the segment uses a video camera.

7. A method as recited in claim 1, wherein the detecting the position of the segment uses a laser scanner.

8. A method as recited in claim 1, wherein the mechanical pick-up system includes a plurality of suction caps coupled to a vacuum system to pick up the plate.

9. A method as recited in claim 8, wherein the mechanical pick-up system includes one or more pick-up arms, each arm rotatably connected to the loading table and having one or more suction caps coupled to the vacuum system.

10. A method as recited in claim 9, wherein the mechanical pick-up system includes a head that moves along a pick-up arm, the arm rotatably coupled to the table and including a plurality of limbs rotatably connected to the head, each limb having a single suction cap coupled to the vacuum system.

11. A method as recited in claim 9, wherein the mechanical pick-up system includes four pick-up arms, each rotatably coupled to the loading table, having a head movable lengthwise along the arm, each head including a single suction cap coupled to the vacuum system.

12. A method as recited in claim 8, wherein the mechanical pick-up system includes one or more bridges across the table movable along the table, the bridges each including one or more suction caps movable along the bridge across the table coupled to the vacuum system.

13. A method as recited in claim 8, wherein each segment includes a plurality of register points, and wherein the detecting of the position of the segment detects the register marks.

14. A method as recited in claim 13, wherein the picking up includes positioning the pick-up system such that the suction caps are close to the detected positions of the register marks, such that the picking up is at pick-up points close to register marks.

15. A method as recited in claim 14, wherein the plate carrier is cylindrical, and wherein the carrying the segment includes:

initially rotating the cylindrical carrier so that the location on the carrier of the roll-off point of the segment is such that the mechanical pick up system can place the roll-off point of the segment thereon, the roll-off point being a point on the final position of the segment, carrying the segment such that the segment's roll-off point can be placed on the location on the carrier of the roll-off point, placing the segment's roll-off point onto the roll-off point location on the carrier, and placing the remainder of the segment on the carrier by translating the mechanical pick-up system and simultaneously rotating the cylinder such that the segment ends placed at its final position.

16. A method as recited in claim 13, wherein the carrying the segment is such that each register point is moved to its correct final position on the carrier, whether or not deformation of the segment occurs during the carrying.

17. A method as recited in claim 13, wherein the carrying the segment is such that the segment is not deformed.

18. A method as recited in claim 13, wherein the picking up includes positioning the pick-up system such that the suction caps are close to the detected positions of the register marks.

19. A method as recited in claim 8, wherein the printing plate carrier is one of a printing sleeve or a mylar sheet mounted on a drum.

20. A method as recited in claim 8, wherein the printing plate segments are flexographic plate segments.

21. A method as recited in claim 8, wherein the printing plate segments are segments of a rubber printing plate.

22. A method as recited in claim 8, wherein the printing plate segments are segments of a letterpress plate.

23. A method for mounting printing plate segments on a printing plate carrier, the method comprising:

accepting positioning data indicative of a set of first positions, each first position being the position on a loading table of a corresponding plate segment of a set of imaged printing plate segments, the positions being positions on a substantially flat working surface of the table;

loading a sheet of plate material containing the set of imaged printing plate segments on the loading table such that after the loading, each segment is approximately at its corresponding first position on the working surface;

accepting positioning data indicative of a set of final positions, each final position being the position of a corresponding printing plate segment on the printing plate carrier; and cutting the segments from the sheet such that the resulting cut segments are maintained at approximately their corresponding first positions;

for each segment of the set of segments, detecting the position of the segment on the loading table;

picking up the segment using a mechanical pick-up system; and carrying the segment using the mechanical pick-up system to the particular segment's corresponding final position on the carrier, the carrying via a path determined using the detected position on the table.

24. A method as recited in claim 23, wherein the printing plate carrier is a cylindrical plate carrier.

25. A method as recited in claim 23, wherein the printing plate carrier is a laid out sheet and the carrying of each segment in on to corresponding final position on the laid out sheet.

26. An apparatus comprising:

a base;

a loading table mechanically coupled to the base and having a substantially flat working surface;

a computer system;

a printing plate carrier;

a mechanical pick-up system mechanically coupled to the base and coupled to the computer system, the pick-up system including a pick up device, and able to reach a segment of printing plate material on the working surface under control of the computer system, pick up the segment, and carry the segment to the drum; and a video detection system coupled to the computer system, the video detection system able to detect the position of a imaged segment of printing plate material on the working surface, wherein, for each segment of a set of imaged printing plate segments loaded on the working surface at an approximate first position indicated by positioning data available to the computer system, the mechanical pick up arm under control of the computer system is further able to:

pick up the segment, and carry the segment to a final position for the segment on the carrier, the carrying via a path determined using the detected position on the table and positioning data available to the computer system about the final position for the segment.

27. An apparatus as recited in claim 26, wherein the printing plate carrier is a cylindrical printing plate carrier, the apparatus further comprising:

a drum rotatably coupled to the base and coupled to the computer system, the drum able to rotate about an axis of rotation under control of the computer system, the drum including the cylindrical printing plate carrier.

28. An apparatus as recited in claim 26, wherein the printing plate carrier is in the form of a sheet, the apparatus further comprising:

a substantially flat surface to hold the carrier laid out thereon.

29. An apparatus as recited in claim 26, wherein the working surface has a set of vacuum holes coupled to a vacuum system, and wherein the set of imaged printing plate segments is loaded in the form of one or more sheets of printing plate material, the loading including turning on the vacuum to the vacuum holes so that the segments are maintained on the working surface.

30. An apparatus as recited in claim 26, wherein the loaded set of imaged printing plate segments are on a sheet of printing plate material, the apparatus further comprising:

a cutting mechanism mechanically coupled to the base and coupled to the computer system to cut the segments of the set of segments from the sheet based on one or more cutting paths.

31. An apparatus as recited in claim 26, wherein the video detecting system includes a video camera.

32. An apparatus as recited in claim 26, wherein the video detecting system includes a laser scanner.

33. An apparatus as recited in claim 26, wherein the mechanical pick-up system includes a plurality of suction caps coupled to a vacuum system to pick up the plate.

34. An apparatus as recited in claim 33, wherein the mechanical pick-up system includes one or more pick-up arms, each arm rotatably connected to the loading table and having one or more suction caps coupled to the vacuum system.

35. An apparatus as recited in claim 34, wherein each mechanical pick-up arm includes a video detecting system coupled to the computer system.

36. An apparatus as recited in claim 34, wherein the mechanical pick-up system includes a head that moves along a pick-up arm, the arm rotatably coupled to the table and including a plurality of limbs rotatably connected to the head, each limb having a single suction cap coupled to the vacuum system.

37. An apparatus as recited in claim 34, wherein the mechanical pick-up system includes four pick-up arms, each rotatably coupled to the loading table, having a head movable lengthwise along the arm, each head including a single suction cap coupled to the vacuum system and a video detection system coupled to the computer system.

38. An apparatus as recited in claim 33, wherein the mechanical pick-up system includes one or more bridges across the table movable along the table, the bridges each including one or more suction caps movable along the bridge across the table coupled to the vacuum system.

39. An apparatus as recited in claim 33, wherein each segment includes a plurality of register points, and wherein the video detecting system is to detect the position of the register marks.

40. An apparatus as recited in claim 39, wherein the picking up of the segment includes positioning the pick-up system such that the suction caps are close to the detected positions of the register marks, such that the picking up is at pick-up points close to register marks.

41. An apparatus as recited in claim 40, wherein the printing plate carrier is a cylindrical printing plate carrier, wherein the apparatus further comprises:

a drum rotatably coupled to the base and coupled to the computer system, the drum able to rotate about an axis of rotation under control of the computer system, the drum including the cylindrical printing plate carrier, and wherein the carrying of the segment to a final position includes:

initially rotating the drum with the cylindrical carrier so that the location on the carrier of the roll-off point of the segment is such that the mechanical pick up system can place the roll-off point of the segment thereon, the roll-off point being a point on the final position of the segment, carrying the segment such that the segment's roll-off point can be placed on the location on the carrier of the roll-off point, placing the segment's roll-off point onto the roll-off point location on the carrier, and placing the remainder of the segment on the carrier by translating the mechanical pick-up system and simultaneously rotating the drum such that the segment ends placed at its final position.

42. An apparatus as recited in claim 39, wherein the carrying of the segment is such that each register point is moved to its correct final position on the carrier, whether or not deformation of the segment occurs during the carrying.

43. An apparatus as recited in claim 39, wherein the carrying of the segment is such that the segment is not deformed.

44. An apparatus as recited in claim 33, wherein the picking up of the segment includes positioning the pick-up system such that the suction caps are close to the detected positions of the register marks.

45. An apparatus as recited in claim 33, wherein the printing plate carrier is one of a printing sleeve or a mylar sheet mounted on a drum.

46. An apparatus as recited in claim 33, wherein the printing plate segments are flexographic plate segments.

47. An apparatus as recited in claim 33, wherein the printing plate segments are segments of a rubber printing plate.

48. An apparatus as recited in claim 33, wherein the printing plate segments are segments of a letterpress plate.

49. An apparatus for mounting printing plate segments on a printing plate carrier, comprising:

means for loading a set of imaged printing plate segments on a loading table, each approximately at a corresponding first position;

means for detecting the position of each segment on the loading table;

mechanical means for picking up each segment and for carrying the segment to a final position for the segment on a printing plate carrier.

50. An apparatus as recited in claim 49, wherein the printing plate carrier is a cylindrical printing plate carrier, the apparatus further comprising:

means for rotating the cylindrical printing plate carrier.

51. An apparatus as recited in claim 49, wherein the printing plate carrier is in the form of a sheet, the apparatus further comprising:

means for holding the carrier laid out substantially flat.

52. An apparatus as recited in claim 49, wherein the table includes a substantially flat working surface and means for holding the segments on the table surface.

53. An apparatus as recited in claim 49, wherein the means for carrying carries using a path determined from the detected position on the table for the segment and the corresponding final position on the carrier.

54. An apparatus as recited in claim 49, wherein the table includes a substantially flat working surface, and wherein the set of imaged printing plate segments are on a sheet of plate material, the apparatus further comprising:

means for cutting the segments from the sheet.

55. An apparatus as recited in claim 49, wherein the means for picking up each segment uses suction to pick up the segment.

56. An apparatus as recited in claim 55, wherein the mechanical pick-up system includes one or more pick-up arms, each arm rotatably connected to the loading table and having one or more suction caps coupled to the vacuum system.

57. An apparatus to mount printing plate segments on a printing plate carrier comprising:

a loading table having a substantially flat working surface onto which a sheet of imaged printing plate segments is loadable such that each segment is loaded at approximately at a corresponding first position;

a video detection system to detect the position of each segment on the loading table;

a printing plate carrier;

a mechanical pick-up system coupled to the table able to pick up each segment at the detected position and carry the segment to a final position for the segment on the plate carrier.

58. An apparatus as recited in claim 57, wherein the printing plate carrier is a cylindrical printing plate carrier, the apparatus further comprising:

a drum able to rotate about an axis of rotation, the drum including the cylindrical printing plate carrier.

59. An apparatus as recited in claim 57, wherein the printing plate carrier is in the form of a sheet, the apparatus further comprising:

a substantially flat surface to hold the carrier laid out thereon.

60. An apparatus as recited in claim 57, further comprising:

a vacuum system; and a set of vacuum holes on the working surface coupled to the vacuum system able to hold the segments on the surface when a vacuum is applied using the vacuum system.

61. An apparatus as recited in claim 60, wherein the mechanical pick-up system includes suction cups coupled to the vacuum system, such that the picking up and carrying uses suction.

62. An apparatus as recited in claim 61, wherein the mechanical pick-up system includes one or more pick-up arms, each arm rotatably connected to the loading table and having one or more suction caps coupled to the vacuum system.

63. An apparatus as recited in claim 62, wherein each pick-up arm includes a video detection system.

64. An apparatus as recited in claim 57, further comprising:

a cutting mechanism to cut the segments from the sheet while the sheet is on the working surface of the table.

65. An apparatus for mounting printing plate segments on a printing plate carrier, comprising:

means for accepting positioning data indicative of a set of first positions, and for accepting positioning data indicative of a set of final positions, each first position being the position on a loading table of a corresponding plate segment of a set of imaged printing plate segments, each final position being the position of a corresponding printing plate segment on the printing plate carrier;

means for loading a sheet of plate material containing the set of imaged printing plate segments onto the loading table such that after the loading, each segment is approximately at its corresponding first position on the working surface;

means for cutting the segments from the sheet such that the resulting cut segments are maintained at approximately their corresponding first positions;

means for detecting the position of each segment on the loading table;

means for picking up each segment at the detected position using a mechanical pick-up system and for carrying the segment to the segment's corresponding final position on the carrier, the carrying via a path determined using the detected position of the segment on the table.

66. An apparatus for mounting flexographic plate segments onto a plate carrier, comprising means for picking up each plate segment at more than two independent points and carrying each segment to a respective final position on the carrier, such that some of the plate segments may need to be deformed to reach their respective final position, wherein, for a plate that is so deformed, the final position cannot be reached by picking up the plate segment at only two points because of the required deformation of the plate.

* * * * *

UNITED STATES PATENT AND TRADEMARK OFFICE

CERTIFICATE OF CORRECTION

PATENT NO. : 6,823,793 B2
DATED : November 30, 2004
INVENTOR(S) : Dewitte

It is certified that error appears in the above-identified patent and that said Letters Patent is hereby corrected as shown below:

Column 13,
Line 57, please change “segment in on to corresponding” to -- segment is on to the corresponding --.

Column 15,
Line 43, please change “segment in on to corresponding” to -- segment is on to the corresponding --.
Line 56, please change “the drum;” to -- a drum; --.

Column 16,
Line 62, please change “register points,” to -- register marks, --.

Column 17,
Line 36, please change “claim 33,” to -- claim 39, --.

Column 18,
Line 18, please change “the vacuum” to -- a vacuum --.

Signed and Sealed this

Twenty-second Day of February, 2005

JON W. DUDAS
*Director of the United States Patent and Trademark Office*